US010323892B2

(12) United States Patent
Tresserras Torre et al.

(10) Patent No.: US 10,323,892 B2
(45) Date of Patent: Jun. 18, 2019

(54) PELLET LOADING SYSTEM

(71) Applicant: GAMO OUTDOOR, S.L., Barcelona (ES)

(72) Inventors: Victor Tresserras Torre, Barcelona (ES); Julian Arnedo Vera, Barcelona (ES)

(73) Assignee: Gamo Outdoor, S.L., Barcelona (ES)

( * ) Notice: Subject to any disclaimer, the term of this patent is extended or adjusted under 35 U.S.C. 154(b) by 0 days.

(21) Appl. No.: 16/064,844

(22) PCT Filed: Feb. 24, 2016

(86) PCT No.: PCT/ES2016/070117

§ 371 (c)(1),
(2) Date: Jun. 21, 2018

(87) PCT Pub. No.: WO2017/125622

PCT Pub. Date: Jul. 27, 2017

(65) Prior Publication Data

US 2019/0003793 A1 Jan. 3, 2019

(30) Foreign Application Priority Data

Jan. 19, 2016 (ES) ..... 201630060

(51) Int. Cl.
*F41B 11/00* (2013.01)
*F41A 9/45* (2006.01)
(Continued)

(52) U.S. Cl.
CPC ..... *F41A 9/45* (2013.01); *F41B 11/54* (2013.01); *F41B 11/55* (2013.01)

(58) Field of Classification Search
CPC ..... F41B 7/006; F41B 11/50; F41B 11/51; F41B 11/54
See application file for complete search history.

(56) References Cited

U.S. PATENT DOCUMENTS 3,741,189 A * 6/1973 Kester ..... F41B 11/54 124/48
5,150,701 A * 9/1992 Wackrow ..... F41B 11/54 124/48
(Continued)

FOREIGN PATENT DOCUMENTS

DE 826852 1/1952
DE 1174653 7/1964
(Continued)

OTHER PUBLICATIONS

PCT International Search Report and Written Opinion, European Patent Office, International Application No. PCT/ES2016/070117, pp. 1-12, Sep. 19, 2016.

*Primary Examiner* — John Ricci
(74) *Attorney, Agent, or Firm* — Hunton Andrews Kurth LLP

(57) ABSTRACT

A break barrel rifle comprises a butt, on which the cylinder (2) is attached, a barrel (3) where the pellet chamber (5) is located, a magazine (12) for pellets (13), together with articulation means (4) and characterised in that it comprises: an elastic rod (6), with a central section (9) and two ends that are coupled to the cylinder (2), a body (10) where the central section (9) of elastic rod (6) is positioned, with forward and backward movement inside said body (10) and that is coupled to the barrel (3) and pushing means (11) linked to the elastic rod (6) and positioned between the pellet (13) to be loaded and the elastic rod (6).

5 Claims, 7 Drawing Sheets

(51) Int. Cl.
*F41B 11/54* (2013.01)
*F41B 11/55* (2013.01)

(56) References Cited

U.S. PATENT DOCUMENTS

| | | | | |
|---|---|---|---|---|
| 5,704,150 | A * | 1/1998 | Milliman | F41A 19/53 42/63 |
| 6,470,871 | B2 * | 10/2002 | Casas-Salva | F41B 11/54 124/48 |
| 8,360,043 | B2 * | 1/2013 | Casas Salva | F41A 17/82 124/72 |

FOREIGN PATENT DOCUMENTS

| | | |
|---|---|---|
| DE | 102011008684 | 9/2012 |
| GB | 545731 | 6/1942 |
| GB | 1253184 | 10/1971 |
| WO | WO 2013074054 | 5/2013 |

* cited by examiner

PELLET LOADING SYSTEM

Pellet loading system, of the type that are employed in rifles like "break barrels" type that comprises a butt which the cylinder is attached to, a barrel, wherein the pellet chamber is located, a pellet magazine, together with articulation means and because it comprises: an elastic rod, with a central section and two ends coupled to the cylinder, a body where the central section of the elastic rod is positioned, with forward and backward movement inside said body and that is coupled to the barrel and pushing means linked to the elastic rod and positioned between the pellet to be loaded and the elastic rod, moving the pushing means to one of the pellets in the magazine at the moment when the barrel is cocked, thus the pushing means leaves a pellet inside the pellet chamber and then said pushing means returns to its initial position when the barrel is closed, thus leaving the rifle loaded.

BACKGROUND TO THE INVENTION

Patents are known in the state of the art, which comprise pellet loading systems for break barrel rifles.

Thus, Patent WO2013074054 is known from 2012, in the name of LUKASHEVYCH ANDRII BOGDANOVICH, which refers to an improvement in a repeating pneumatic air pistol with a feed belt that aims at achieving a cartridge arrangement in a more compact manner on the cartridge belt, which permits the belt to be loaded without the need for any additional instruments and which provides a feed mechanism for the new cartridge belt design. The pistol comprises a cylinder, a chamber, a valve shaft to feed the compressed gas to the barrel bore, a hammer to open the valve, a hammer to activate firing, a bolt to seat the cartridges in the barrel bore and seal the orifice, a cartridge belt and a cartridge belt feed mechanism to move the cartridge belt and reload the weapon. The cartridge belt constitutes a single component made of elastic material that has a series of openings of a smaller diameter than the cartridges loaded on the belt. The cartridge belt feed mechanism comprises a slider mounted on the chamber so that it is able to move in parallel to the barrel, a lever mounted on top of the slider, said lever is connected in an articulated manner to the chamber and it is pressed on the slider by means of a spring and a spring mounted on the end of the lever and participating with the cartridge belt, in which the bolt has a lateral protuberance located inside a longitudinal slot in the slider.

BRIEF DISCLOSURE OF THE INVENTION

This invention refers to the pellet loading systems in break barrel rifles, although it could also be understood as included in those break barrel pistols.

One of the greatest problems currently existing in break barrel rifles that have a pellet magazine is that when the pellets are housed in the pellet magazine, any misalignment between the barrel and the magazine could damage the pellet at the moment of firing because the pellet does not follow the correct path inside the barrel.

There is also the problem of losing power through leaking air pressure between the cylinder and the magazine, which affects the initial path of the pellet at the moment of being separated from the magazine.

In order to resolve the problem, the inventors have invented a system, in which a pusher extracts the pellet from the actual pellet magazine and positions it inside the pellet chamber. On the one hand, this assumes that the misalignment between the barrel and the cylinder does not affect the pellet at the moment of firing, because the pellet is already inside the pellet chamber, On the other, the power losses due to leaks do not affect the pellet either, because it is already inside the pellet chamber.

One object of this invention is a pellet loading system, of those that are employed in rifles with "break barrels" of the type that comprises a butt, on which the cylinder is attached, a barrel, where the pellet chamber is located, a pellet magazine, together with articulation means and because it comprises: an elastic rod, with a central section and two ends that couple to the cylinder, a body where the central section of the elastic rod is positioned, with forward and backward movement inside said body and that is fixed to the barrel and pushing means linked to the elastic rod and positioned between the pellet to be loaded and the elastic rod, moving the pushing means to one of the pellets in the magazine at the moment when the barrel is broken, thus the pushing means leaves a pellet inside the pellet chamber and then said pushing means returns to its initial position when the barrel is closed, thus leaving the rifle loaded.

BRIEF DESCRIPTION OF THE DRAWINGS

In order to facilitate the description, this report is accompanied by seven sheets of drawings that represent a practical exemplary embodiment, which is cited as a non-limiting example of the scope of this invention.

SPECIFIC EXEMPLARY EMBODIMENT OF THIS INVENTION

Figure 1:
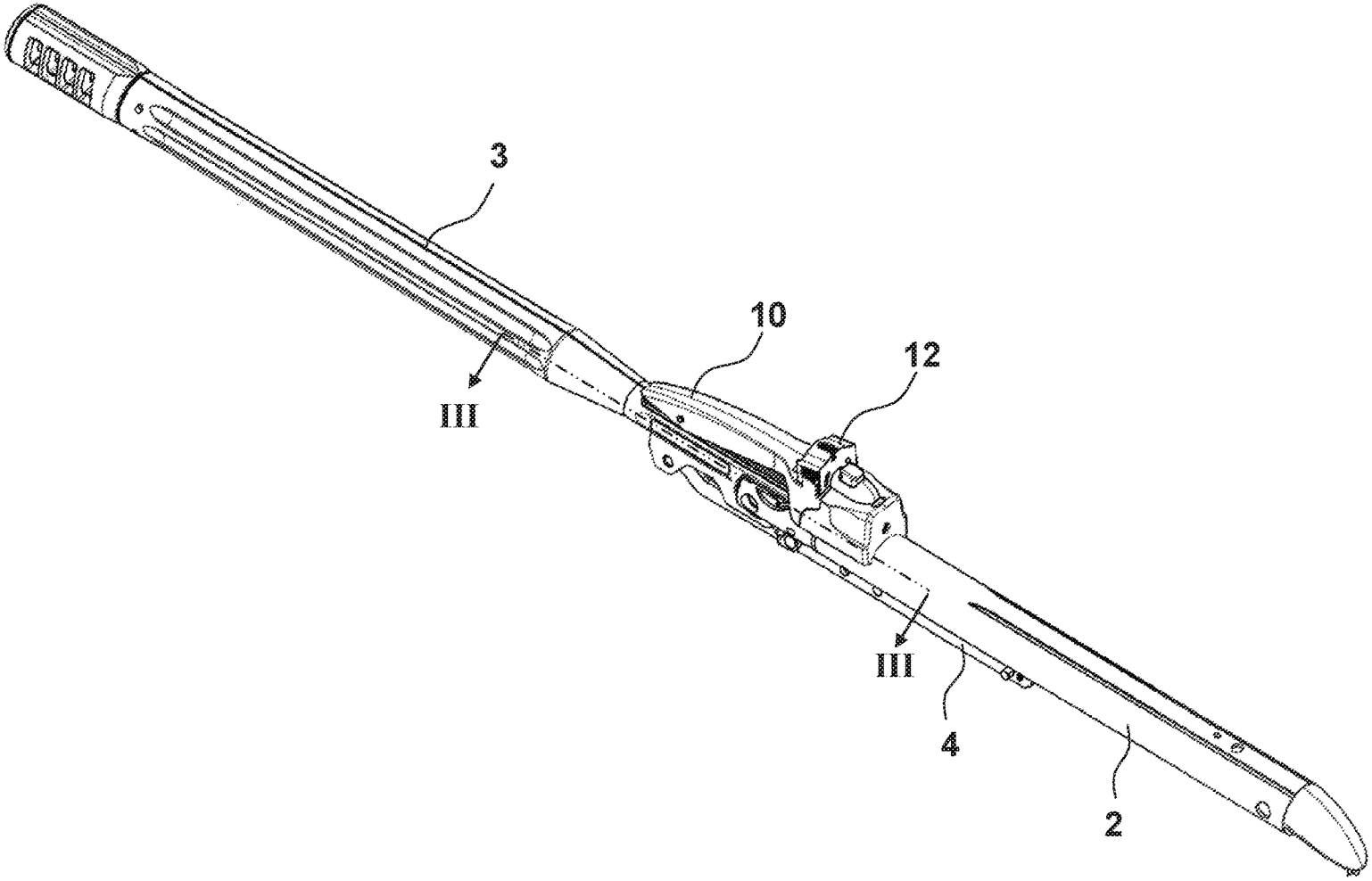
FIG. 1 is a perspective view of the invention with a rotating magazine.

FIG. 1 shows a cylinder 2, a barrel 3, a articulation means 4, a body 10 and a magazine 12.

Figure 2:
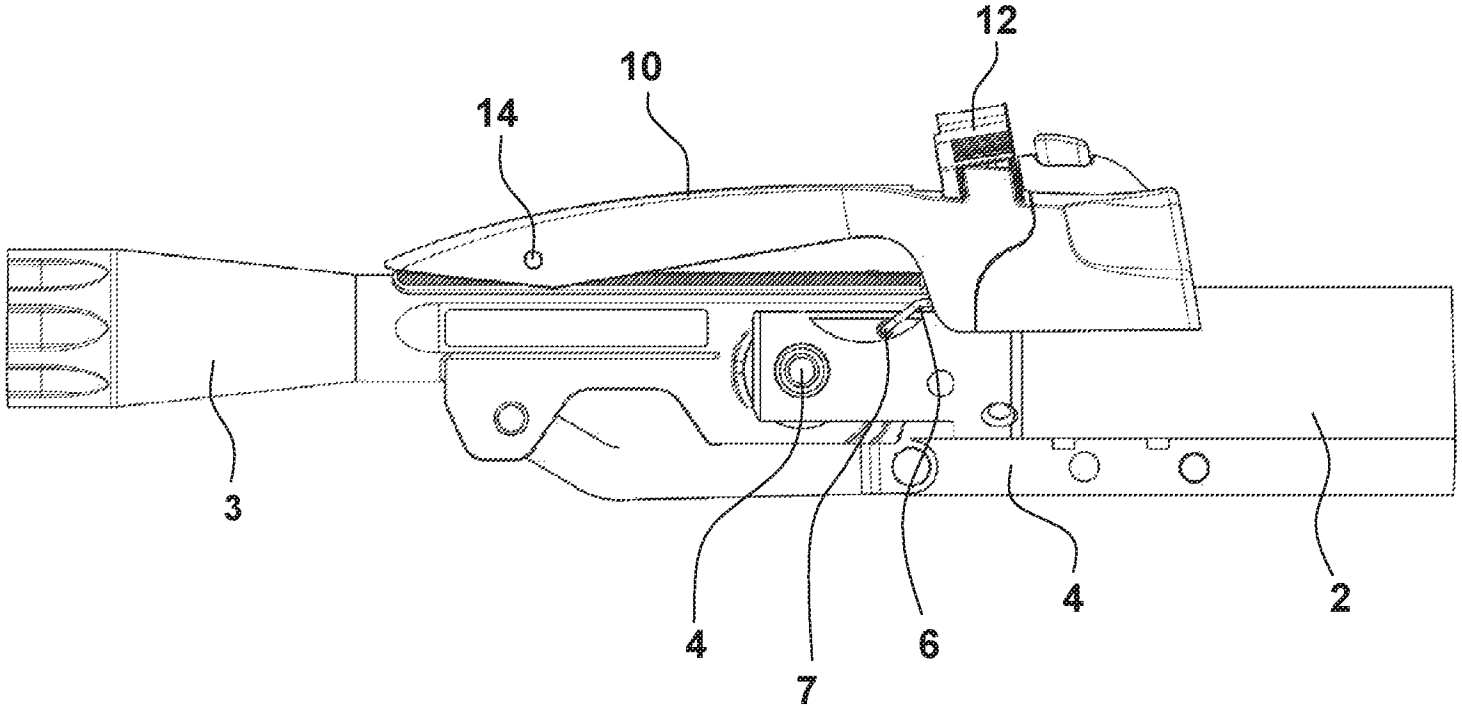
FIG. 2 is a close-up lateral view of the barrel articulation zone.

FIG. 2 illustrates the cylinder 2, the barrel 3, articulation means 4, an elastic rod 6 and one end 7, body 10, pin 14 and magazine 12.

Figure 3:
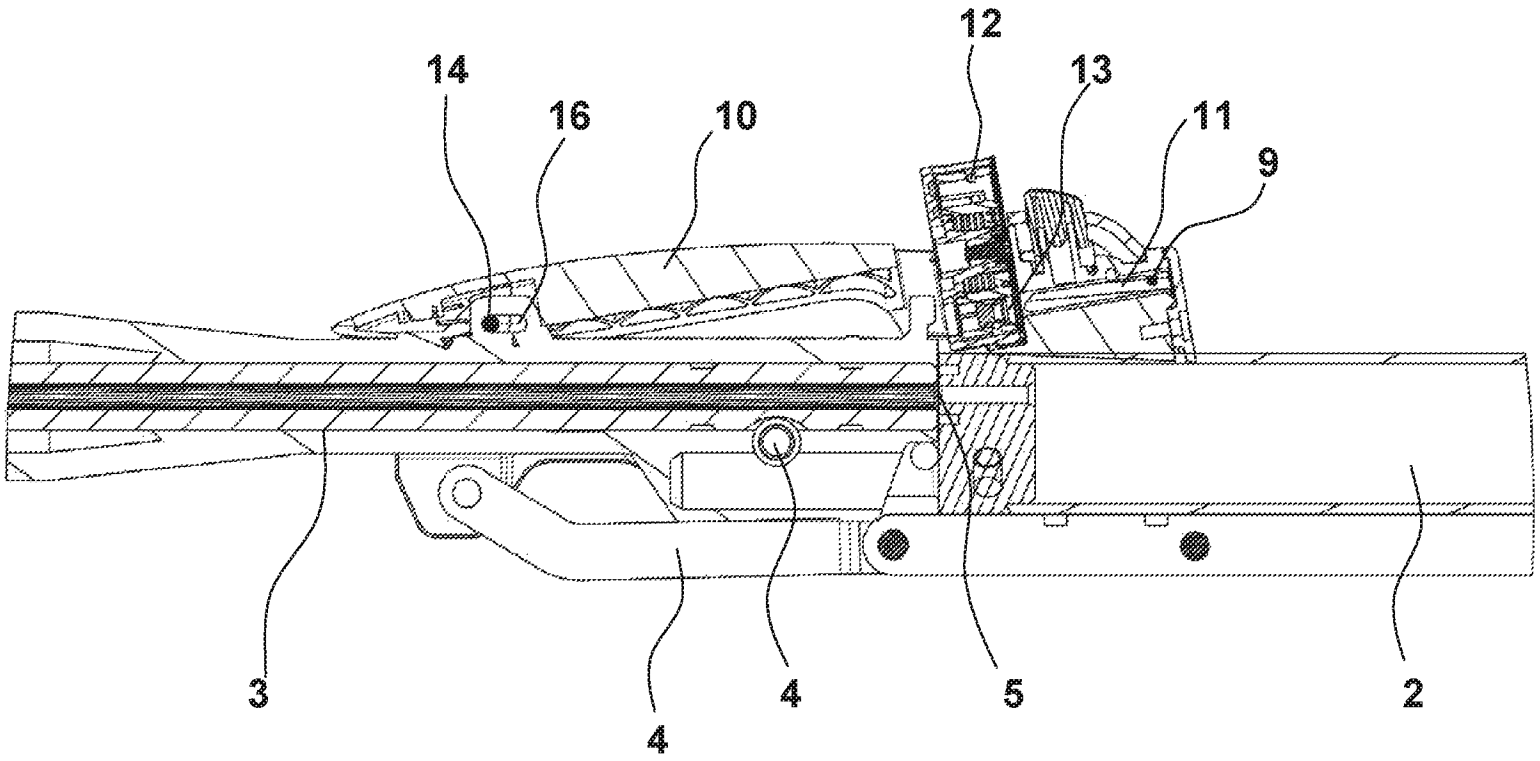
FIG. 3 is a sectional view of FIG. 1 along line III-III.

FIG. 3 represents the cylinder 2, barrel 3 and pellet chamber 5, articulation means 4, body 10 with pin 14 and elongated opening 16 and magazine 12 with pellet 13.

Figure 4:
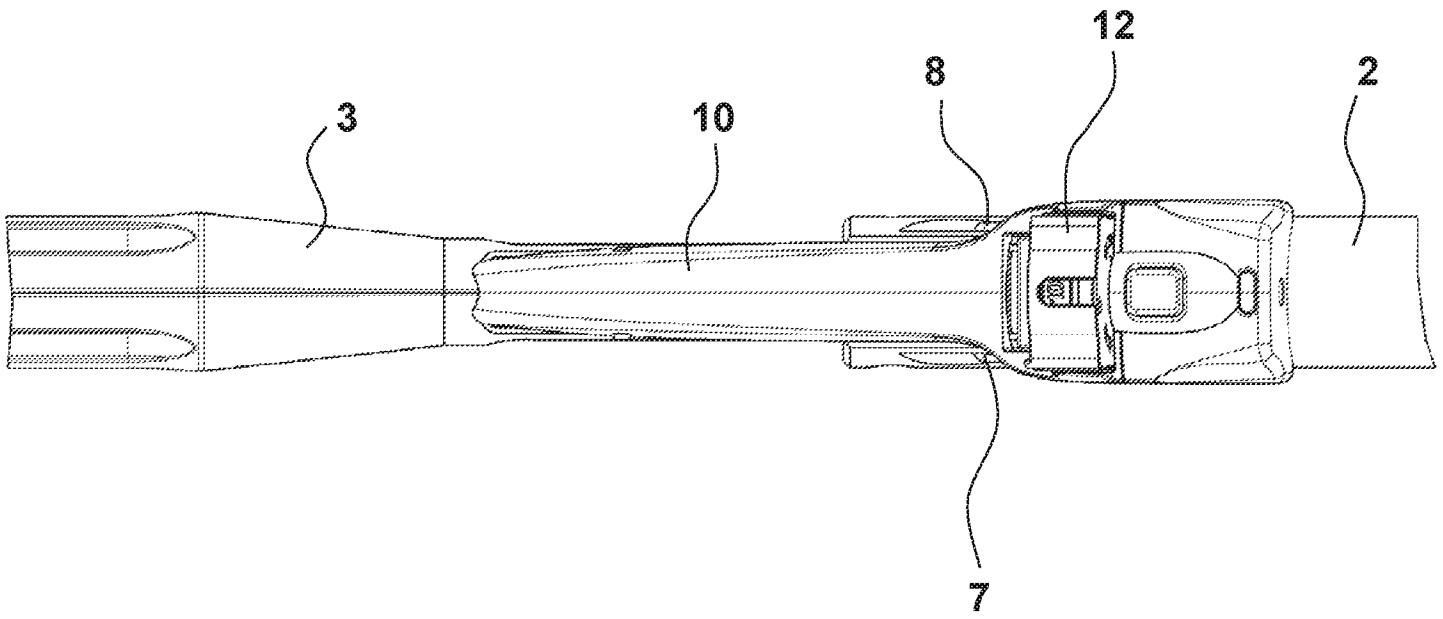
FIG. 4 is a plan view of FIG. 1 without the body.

FIG. 4 illustrates the cylinder 2, barrel 3, ends 7 and 8 of elastic rod 6, body 10 and magazine 12.

Figure 5:
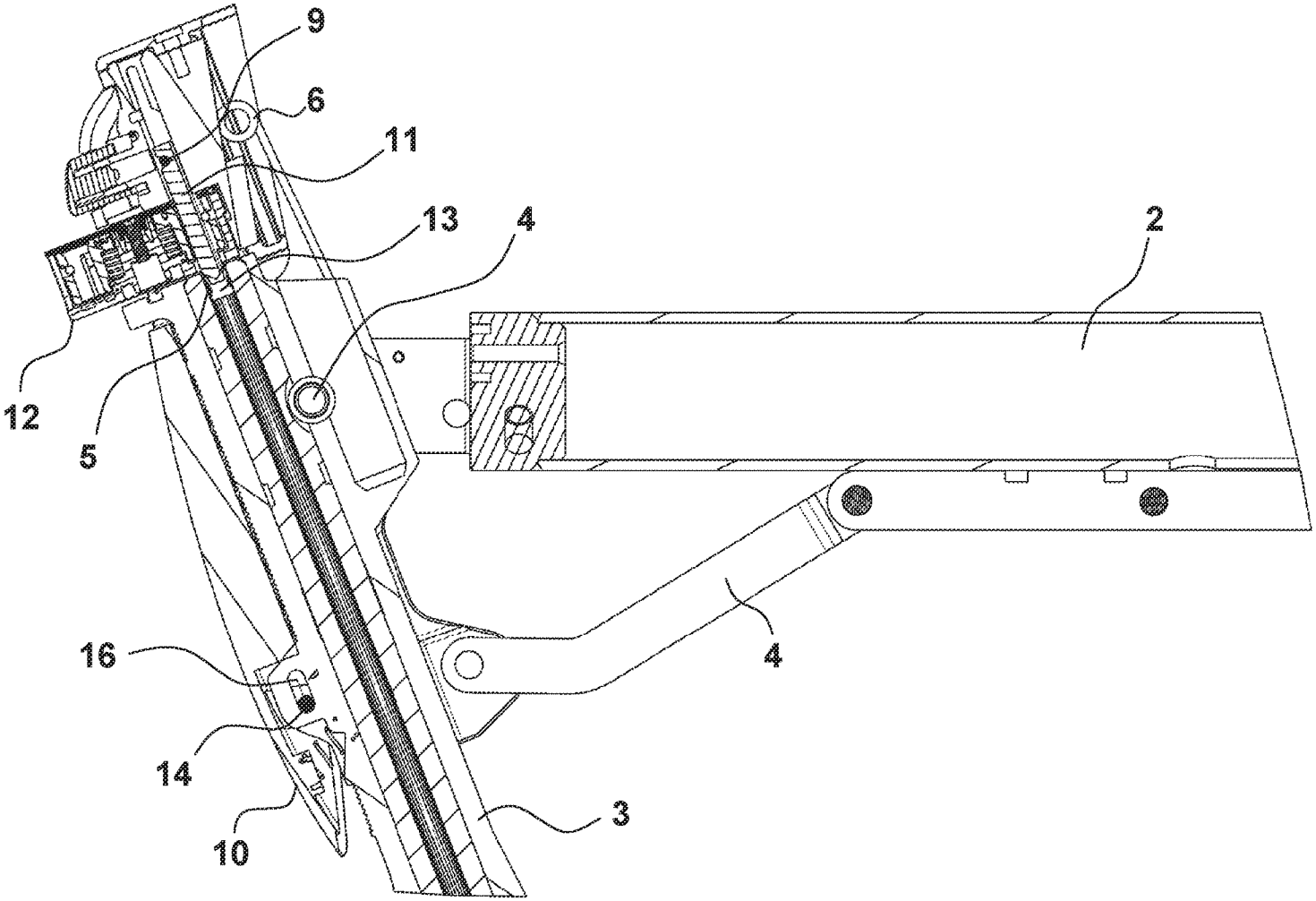
FIG. 5 is a sectional view continuing from FIG. 3 with the barrel broken, inserting the pellet into the barrel.

FIG. 5 shows the cylinder 2, barrel 3 and pellet chamber 5, articulation means 4, elastic rod 6 with its central section 9, pushing means 11, body 10 with pin 14 and elongated opening 16 and magazine 12 with pellet 13.

Figure 6:
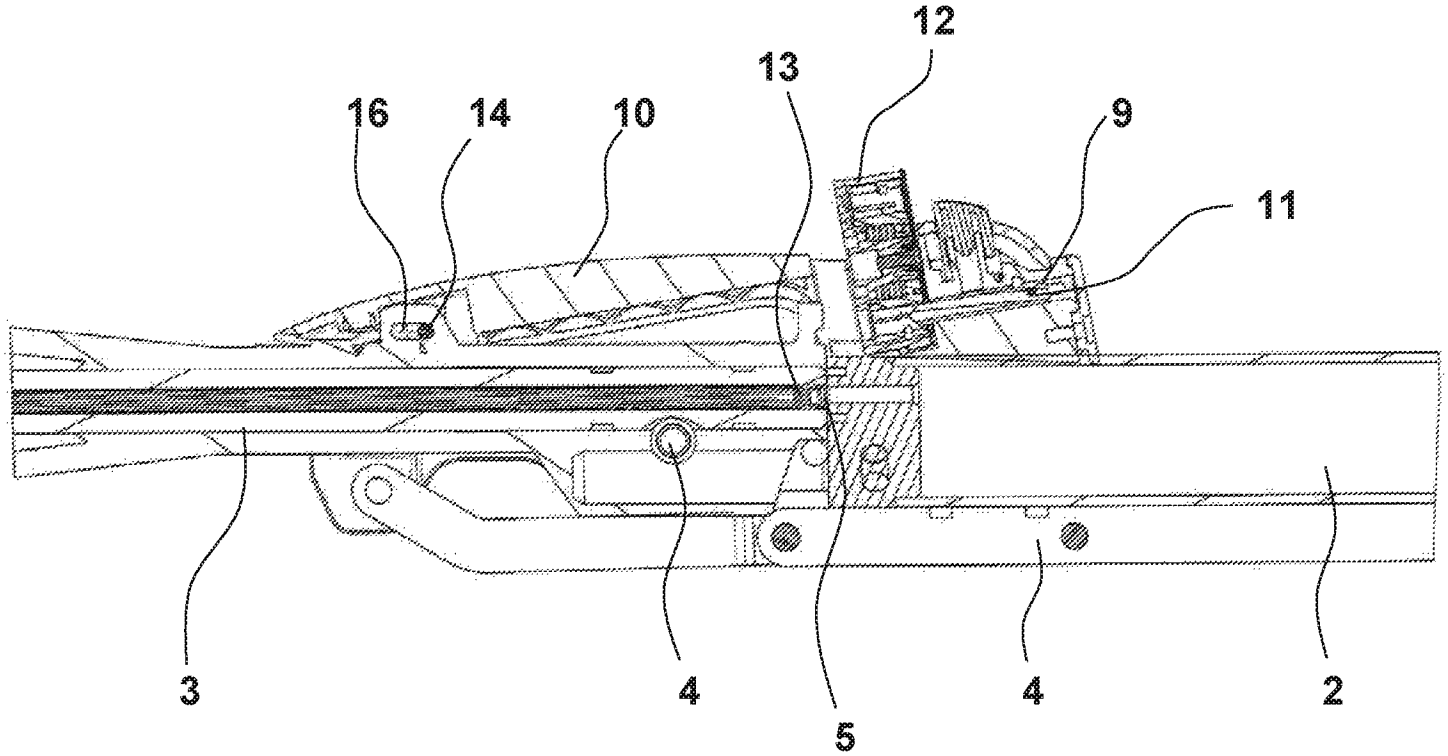
FIG. 6 is a sectional view continuing from FIG. 3 with the mechanism retracted and FIG. 7 is a perspective view of the invention with a linear magazine.

FIG. 6 illustrates the cylinder 2, barrel 3 and pellet chamber 5, articulation means 4, central section 9, pushing means 11, body 10 with pin 14, elongated opening 16 and magazine 12 with pellet 13.

Figure 7:
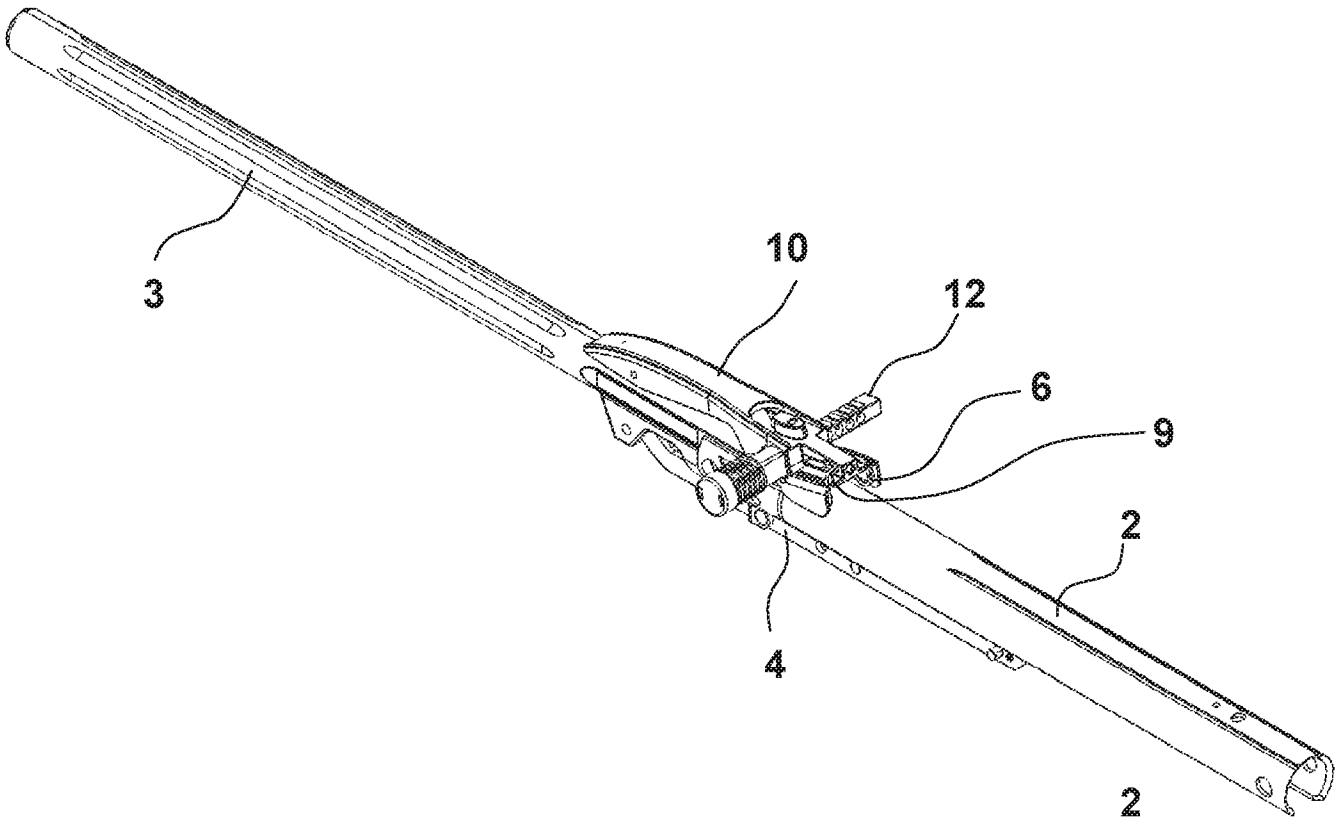

Lastly, FIG. 7 represents the cylinder 2, barrel 3, articulation means 4, elastic rod 6, central section 9, body 10 and magazine 12.

Thus, in a specific exemplary embodiment, the pellet loading system is employed in break barrel rifles as shown in FIG. 1.

The rifle comprises two parts, the cylinder 2, which is seated on the butt (not shown) and barrel 3, which is cocked in order to load the pellet. Said two parts are articulated by articulation means 4. The barrel 3 is where the pellet chamber 5 is housed, which is where, inside the barrel bore, pellet 13 is housed before being fired.

The pellet 13 is held inside a pellet magazine 12.

The system also comprises elastic rod 6, which is configured with central section 9 and two ends 7 and 8. The two ends 7 and 8 are housed in cylinder 2 so that elastic rod 6 is joined to said cylinder 2. Later, it will be explained that said ends 7 and 8 allow the partial rotation of elastic rod 6 when barrel 3 is cocked.

It also comprises body 10 where central section 9 of elastic rod 6 is positioned. Said body 10 is fixed to barrel 3. This special configuration, as will be explained in more detail later, means that when barrel 3 is cocked, the body 10 drags the elastic rod along with it and said elastic rod 6 then rotates because of ends 7 and 8.

Elastic rod 6 is coupled as pushing means 11, which is what pushes pellet 13, extracting it from the pellet magazine 12 and inserting it into the pellet chamber 5.

Thus, when the barrel 3 is cocked to load a pellet 13, said barrel 3 drags body 10 along. Said body 10 may be welded to said barrel 3 or joined, as in the embodiment of FIG. 5, by a pin 14 which, because it has movement inside elongated apertures 16, can prevent breakages caused by the generated forces.

Because the aforementioned pin 14 has the alluded movement inside elongated apertures 16, it is assumed that if, for whatever reason, the insertion of pellet 13 into pellet chamber 5 fails, body 10 would move and allow pellet 13 to exit (FIG. 6).

Since the body 10 is coupled to the flexible rod 6, it is also dragged along. In turn, the flexible rod 6 is coupled to cylinder 2 by means of alluded ends 7 and 8, which rotate, allowing flexible rod 6 to move with body 10 and, at the same time, remain coupled to cylinder 2.

All this assumes that central section 9 of flexible rod 6 and elastic rod 6, move in relation to body 10, advancing towards magazine 12.

As previously described, the pushing means 11 is coupled to the elastic rod 6, so when said elastic rod 6 moves with respect to body 10, pushing means 11, which is between the elastic rod 6 and the pellet 13 to be loaded, approaches pellet 13 until pushes it, removing the pellet 13 from the magazine 12 and housing the pellet 13 inside the pellet chamber 5 (FIG. 5).

When the pellet 13 has been loaded into the pellet chamber 5, the closing movement of the barrel 3 is executed, leaving the pellet 13 ready for firing.

Said closing movement assumes that the body 10, when it moves with the barrel 3, which closes, causes the flexible rod 6 to approach the cylinder 2 with the pusher 11 moving backwards and exiting the magazine 12 to the initial position when the barrel finally closes, leaving the rifle loaded.

Optionally, just as shown in FIG. 4, pushing means 11 is coupled to the central section 9 of the elastic rod 6.

In this embodiment, the elastic rod 6 adopts an "L" shape with two loops, although, depending on the materials of which the elastic rod 6 is made, this shape could change.

There is the option of the pellet magazine 12 being automatic. If it is manual, the user should push, for example, on a manual linear magazine to position the next pellet 13 ready to be pushed by pushing means 11.

If it is automatic, as in the exemplary embodiment, pushing means 11 returns to the initial position at the moment when barrel 3 is closed, leaving the rifle loaded and the magazine 12 (these embodiments show one rotary and one fixed), which incorporates a spring, supplies a new pellet 13 ready to be pushed by pushing means 11.

As one of the possible manufacturing modes, the magazine 12 is housed in the body 10 so that it is the body 10 that maintains the stability of the magazine 12.

This invention patent describes a new pellet loading system. The examples mentioned here do not limit this invention and thus, it can have various applications and/or adaptations, all of which are within the scope of the following claims.

What is claimed is:

1. A break barrel rifle comprising a butt, on which a cylinder (2) is attached, a barrel (3), where a pellet chamber (5) is located, a pellet (13) magazine (12), together with articulation means (4) and a pellet loading system, characterised in that it comprises:

an elastic rod (6), with a central section (9) and two ends (7, 8), said ends (7, 8) are coupled to said cylinder (2), a body (10) for housing said magazine (12) and pivotally attached to said barrel (3), where the central section (9) of the elastic rod (6) is positioned to enable forward and backward movement of the elastic rod (6) inside said body (10)and pushing means (11) coupled to the elastic rod (6) and positioned between the pellet (13) to be loaded and the elastic rod (6), the pushing means (11) moving to one of the pellets (13) in the magazine(12) at the moment when said barrel (3) is broken, thus the pushing means leaves a pellet (13) inside the pellet chamber (5) and then said pushing means (11) returns to its initial position when the barrel (3) is closed, thus leaving the rifle loaded.

2. A break barrel rifle in accordance with claim 1 characterised in that the pushing means (11) is coupled to the central section (9) of the elastic rod (6).

3. A break barrel rifle in accordance with claim 1 characterised in that the elastic rod (6) adopts an "L" shape.

4. A break barrel rifle in accordance with any of the previous claims characterised in that the magazine (12) of the pellets (13) is automatic and when pushing means (11) returns to the initial position at the moment when barrel (3) closes, leaving the rifle loaded, the magazine (12) supplies a new pellet (13) ready to be pushed by the pushing means (11).

5. A break barrel rifle in accordance with claim 1 characterised in that the body (10) comprises elongated apertures (16), in which the pin (14) slides and on which the body (10) articulates at the moment of cocking and closing the barrel (3).

* * * * *